US008532837B2

(12) United States Patent
Efecik et al.

(10) Patent No.: US 8,532,837 B2
(45) Date of Patent: Sep. 10, 2013

(54) HOUSEHOLD APPLIANCE

(75) Inventors: Bulent Efecik, Istanbul (TR); Latif Tezduyar, Istanbul (TR); Ufuk Levan Yakut, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 148 days.

(21) Appl. No.: 13/003,295

(22) PCT Filed: Jul. 7, 2009

(86) PCT No.: PCT/EP2009/058601

§ 371 (c)(1), (2), (4) Date: Jan. 7, 2011

(87) PCT Pub. No.: WO2010/003952

PCT Pub. Date: Jan. 14, 2010

(65) Prior Publication Data

US 2011/0118895 A1 May 19, 2011

(30) Foreign Application Priority Data

Jul. 7, 2008 (TR) ..... a 2008 05006

(51) Int. Cl.

| | |
|---|---|
| ***G05D 3/12*** | (2006.01) |
| ***G05D 5/00*** | (2006.01) |
| ***G05D 9/00*** | (2006.01) |
| ***G05D 11/00*** | (2006.01) |
| ***G05D 17/00*** | (2006.01) |
| ***G05B 11/01*** | (2006.01) |
| ***G01R 21/06*** | (2006.01) |
| ***G01R 11/56*** | (2006.01) |
| ***G01R 21/133*** | (2006.01) |
| ***G06F 17/00*** | (2006.01) |

(52) U.S. Cl.

USPC ..... 700/296; 700/16; 702/62; 705/412

(58) Field of Classification Search

USPC ..... 700/11, 16–19, 22, 286, 291, 295–297; 702/57, 60–62; 705/412; 340/1.1, 4.3, 4.32, 340/4.33

See application file for complete search history.

(56) References Cited

U.S. PATENT DOCUMENTS

| | | | | |
|---|---|---|---|---|
| 7,110,832 | B2 * | 9/2006 | Ghent | 700/16 |
| 7,821,156 | B2 * | 10/2010 | Katz et al. | 307/40 |
| 8,234,018 | B2 * | 7/2012 | Besore et al. | 700/296 |
| 8,249,731 | B2 * | 8/2012 | Tran et al. | 700/94 |
| 2003/0178894 | A1 | 9/2003 | Ghent | |
| 2007/0136217 | A1 * | 6/2007 | Johnson et al. | 705/412 |
| 2010/0146712 | A1 * | 6/2010 | Finch et al. | 8/137 |
| 2010/0175719 | A1 * | 7/2010 | Finch et al. | 134/18 |
| 2012/0073603 | A1 * | 3/2012 | Graven | 134/18 |

FOREIGN PATENT DOCUMENTS

| | | | |
|---|---|---|---|
| EP | 1413936 | A1 | 4/2004 |
| JP | 4109995 | A | 4/1992 |
| JP | 7112093 | A | 5/1995 |
| JP | 2003111311 | A | 4/2003 |
| JP | 2006149788 | A | 6/2006 |
| WO | 2007060059 | A | 5/2007 |

* cited by examiner

*Primary Examiner* — Crystal J Barnes-Bullock

(74) *Attorney, Agent, or Firm* — Venable, Campillo, Logan & Meaney PC

(57) ABSTRACT

The present invention relates to a household appliance (1) comprising a control unit (4) that maintains to execute the selected program as much as possible within the discounted rate interval when the user enters the end time ($t_f$) for the selected program, by evaluating the clock (2) data and the momentary energy tariff signal received from the sensing means (3) within the time passing until the end time ($t_f$) and guarantees completion of the program to be executed before the selected end time ($t_f$).

12 Claims, 1 Drawing Sheet

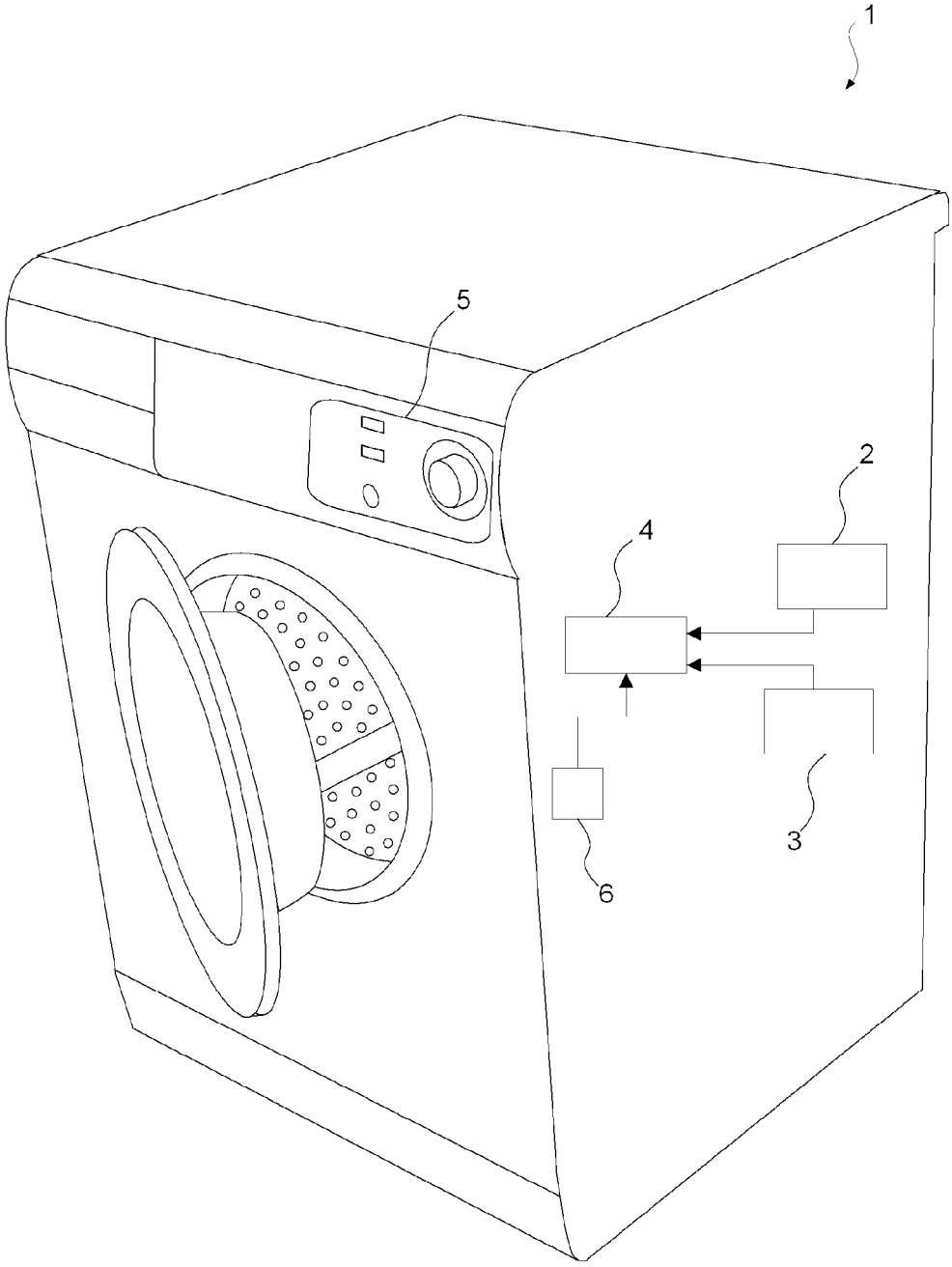
1
5
2
4
3
6

HOUSEHOLD APPLIANCE

FIELD

The present invention relates to a household appliance that can be operated in compliance with the energy tariff.

BACKGROUND

The decreasing energy resources in the world, increasing population and the energy per capita necessitates the efficient usage of limited energy sources and hence making changes in the energy production and distribution systems. With this need and taking into consideration that the energy consumption is intensified at certain hours during the day, methods such as variable energy pricing at these hours and determining the tariff according to the load of the network are used. Energy costs are tried to be decreased by designing household appliances in compliance with the systems wherein the tariff varies dynamically depending on the load, intensity of the network.

In the state of the art, Japanese patent application no JP2003111311, a structure for reducing the cost of electric energy comprising a charge information processor, a power controller, and a load power sensor is described. In this embodiment, the charge information processor calculates the price of the electric power by using the electric unit price received from the electric producer company and the electric power load data received from the load power sensor. The power controller compares the result of this calculation with the reference price prerecorded in the operation panel relating to the desired consumption of the electric household appliances connected to this structure. When the calculated value exceeds the reference value, the energy of the household appliances connected to this structure is cut off with a certain order of priority by the decision of the power controller thereby optimizing the energy cost.

In the state of the art, Japanese Patents No JP4109995 and No JP7112093, embodiments are provided for use of energy in the night hours having discounted energy tariff in order to save energy.

The object of the present invention is the realization of a household appliance with a low energy cost and that can be operated in compliance with the energy tariff.

The household appliance realized in order to attain the aim of the present invention is explicated in the claims.

In the household appliance of the present invention, the user enters the ending time of the program to be executed during the selection of the program. The household appliance comprises a control unit that guarantees completion of the selected program within the desired time limit, maintaining to execute the program in the time interval of the discounted rate as much as possible by evaluating together the clock measuring time and the data received from the sensing means detecting the discounted rate energy signals when connected to a network wherein the energy tariff changes dynamically.

The user indicates the desired end time for ending the program together with the program selection by means of a panel disposed on the household appliance. The total duration between the time of selecting the program and the desired end time is calculated by the control unit. If the program selection is made within the time interval when energy is given in the expensive tariff by the network and if there is a longer time for executing the program than is necessary for the control unit, the control unit waits for the discounted rate energy signal from the network by not starting the program right away. During this waiting period, the control unit momentarily updates how much time has passed from the time required for completing the program and the remaining time left with the data received from the clock. When the discounted rate energy signal from the energy network is detected by the sensing means, the control unit starts the program execution process.

If a discounted rate energy signal cannot be received from the network to which the household appliance of the present invention is connected until the desired end time for the program set by the user, the control unit determines the latest time for starting the program in order to end the program in the selected end time and executes the program during this time period even if it is in the expensive tariff. Accordingly, a household appliance is supplied for the user that not only guarantees the selected program to be completed at the desired end time but also the cost of energy consumption is reduced hence utilization becomes more functional.

SUMMARY

In an embodiment of the present invention, as the control unit executes the selected program, it maintains that the time period of running the program remains within the time interval wherein the discounted rate energy signal is received as much as possible, in other words in an intermittent manner, provided that the end time determined by the user is not exceeded. In this case, the control unit provides the continuation of the executed program as long as the discounted rate energy signal is received from the network and when the energy tariff changes to a more expensive rate, stops the program. In this phase, the control unit takes into consideration the latest time the program is desired to end in accordance with the data received from the clock and waits for receiving the discounted rate energy signal from the network. In the case when the discounted rate energy signal is received from the network again, the program is resumed and accordingly the program is completed.

In another embodiment of the present invention, as the control unit executes a program having more than one step, it maintains that the time period of running the program steps remains within the time interval wherein the discounted rate energy signal is received as much as possible, in other words in an intermittent manner, provided that the end time determined by the user is not exceeded. In this case, the control unit provides the continuation of the executed program step as long as the discounted rate energy signal is received from the network. But when the energy tariff changes to a more expensive rate, the control unit prevents from going to the next step. In this phase, the control unit takes into consideration the latest time the program is desired to end in accordance with the data received from the clock and waits for receiving discounted rate energy signal from the network. In the case when the discounted rate energy signal is received from the network again, the program step is resumed and thus the program is completed. Consequently, the cost of the energy consumed by the household appliance is aimed to be kept at an optimum level.

In another embodiment of the present invention, the time intervals of receiving the discounted rate energy signals from the network are recorded in the memory daily. As this data kept in the memory is delivered to the control unit, the control unit learns the hours of the day the discounted rate energy signals are received in general. Accordingly, the control unit executes the program steps by using energy having the discounted rate as much as possible and by using the data about which hours of the day the discounted rate energy is delivered thereby satisfying the condition of definitely finishing the program at the desired end time. Since the tariff for the energy delivered by the energy network changes continuously depending on the intensity of the network, the discount rate in the cost of the energy consumed by the household appliance is maximized by executing the program steps in the hours when energy is cheaper.

In another version of this embodiment, the control unit serves to inform and guide the user by evaluating the data kept in the memory about in which time interval the daily discounted rate energy signals are received. When the user enters the desired end time for finishing the program to be performed, the control unit controls whether or not there is a time interval for receiving the discounted rate energy signals from the network by evaluating the data kept in the memory. If there is no discounted rate energy tariff to be applied in the time period until the program end time desired by the user, the control unit warns the user about the absence of a discounted rate energy tariff to be applied in the network until the desired program end time. Moreover, in this case the control unit guides the user for usage of cheaper rate energy usage by proposing a new end time to the user.

BRIEF DESCRIPTION OF THE DRAWINGS

The household appliance realized in order to attain the aim of the present invention is illustrated in the attached figures, where:

FIG. 1—is the perspective view of a household appliance.

DETAILED DESCRIPTION

The elements illustrated in the figures are numbered as follows:

1. Household appliance
2. Clock
3. Sensing means
4. Control unit
5. Panel
6. Memory The following symbols are used for explaining the household appliance (1) of the present invention.

$t_f$: The end time the user wants the program to be completed $t_{pt}$: The total duration of the program $t_t$: The total time that will pass until the end time of the program.

The household appliance (1) of the present invention comprises a clock (2) that measures time, a sensing means (3) that detects the discounted rate energy signal coming from the network when connected to an energy network wherein the energy tariff changes dynamically, a control unit (4) that evaluates the clock (2) and the signal received from the sensing means (3) and a panel (5) which enables the user to select programs. When the user enters the desired end time ($t_f$) for the program to be executed, the control unit (4) maintains to execute the program as much as possible in the time interval when the discounted rate is applied by evaluating together the clock (2) data and the signal received from the sensing means (3) within the time passing until the end time ($t_f$) and guarantees completion of the program to be executed before the selected end time ($t_f$).

A pricing system that changes momentarily according to the load of the network is used in the electric network to which the household appliance (1) of the present invention is connected. The user selects the program to be executed by using the panel (5) disposed on the household appliance (1) and enters the desired end time ($t_f$) for the program to finish. The total time of the program ($t_{pt}$) selected by the user is determined by means of the control unit (4). The control unit (4) furthermore calculates the remaining time between the present time and the program end time ($t_f$) entered by the user and thereby determines the total time ($t_t$) that will pass until the end time ($t_f$) of the program.

The sensing means (3) detects the discounted rate energy signal coming from the energy network momentarily and delivers to the control unit (4). The control unit (4) starts the program selected by the user in accordance with the discounted rate energy signal coming from the sensing means (3). The control unit (4) maintains the continuation and completion of the running program as long as the discounted rate energy signal is detected from the energy network.

The control unit (4) evaluates the total duration of the program ($t_{pt}$) and the total time remaining ($t_t$) until the end time of the program ($t_f$) and subtracts the total duration of the program ($t_{pt}$) from the program end time ($t_f$) to determine the latest time for starting the program. If discounted rate energy signal is not received by the sensing means (3) in the time interval between the moment of selecting the program by the user and the desired time for ending the program, the control unit (4) starts and executes the program selected by the user before the end time ($t_f$) entered by the user at the latest starting time even if it is within the expensive energy tariff. Accordingly, customer satisfaction is increased by guaranteeing the completion of the program at the end time ($t_f$) desired by the user.

In the preferred embodiment of the present invention, the clock (2) is a real time clock. Thus, the household appliance (1) is enabled to receive the time data with a high accuracy and precision.

In an embodiment of the present invention, during the executed program if there is a change in the signal detected from the energy network, for example if expensive tariff signal is detected instead of the discounted rate signal, this case is again evaluated by the control unit (4) and the program is interrupted and kept at stand-by until the discounted rate signal is received again. The control unit (4) resumes the execution of the program when the discounted rate signal is detected again by the sensing means (3). Thus, the control unit (4) can execute the program intermittently as much as possible in the time intervals when the discounted rate signal is detected such that the program is guaranteed to be completed before the end time ($t_f$) indicated by the user.

In another embodiment of the present invention, during the execution of a program having more than one step, in the case the discounted rate energy signal changes to the expensive tariff, the program step that is already running is completed and the waiting phase is started without going on to the next program step. As soon as the waiting phase starts, the control unit (4) determines the remaining time for the program by using the data received from the clock (2). The control unit (4) furthermore continuously updates the time remaining until the program end time ($t_f$) desired by the user by using the data received from the clock (2). Accordingly, the control unit (4) determines the latest time the executed program will be restarted within the waiting duration. The control unit (4) maintains to restart the executed program by evaluating the discounted rate energy signal received from the sensing means (3) momentarily together with the data received from the clock (2) during the waiting phase and completes the program before the end time ($t_f$) initially entered by the user. In the case the sensing means (3) receives discounted rate energy signal from the energy network within the waiting phase and informs the control unit (4), the control unit (4) restarts the program by resuming the last program step and executes the program as long as the discounted energy tariff continues. If there is a change again in the energy tariff detected by the sensing means (3) from the energy network and if the tariff changes to the expensive rate again, the executed program step is completed and the waiting cycle is repeated for the next program step. Thus, by operating the executed program intermittently, with the condition that the program is completed at the program end time ($t_f$) entered by the user, the cost of the consumed energy is minimized.

For example, in the case the household appliance (1) is a washing machine, the washing process is generally made up of pre-washing, main washing, rinsing and spinning steps. After the user selects the program to be executed and after receiving the discounted rate energy signal, this signal is delivered to the control unit (4) and the selected program is started to be executed. The control unit (4) executes the selected washing program steps respectively as long as the discounted rate energy signal is received by the sensing means (3). If for example, there is a change in the discounted rate energy signal received from the network and if expensive rate energy signal is received, the control unit (4) runs the program until the main washing step is completed, on the other hand prevents the next program step, the rinsing step from starting. During program selection, if there is enough time until the end time ($t_f$) indicated by the user, the executed program is kept waiting until the discounted rate energy signal is received from the network again. Consequently, even if expensive rate energy signal is received, the main washing program is continued, the washing process is performed in the water heated at the start of the program and the water that cools during waiting is prevented from being reheated. Moreover, since in such a case, the type of adversaries such as the laundry waiting in the water causing risks of the colors mingling with one another etc. are also prevented. In the case when the discounted rate energy signal is detected from the energy network again, the executed program starts to continue from the resumed step and is definitely completed until the end time ($t_f$) initially indicated by the user. Consequently, the program selected by the user is executed intermittently and the program steps are carried through as much as possible in the time intervals wherein discounted rate energy signal is received. Accordingly, the cost of the consumed energy is minimized guaranteeing the selected program to be completed until the end time ($t_f$) desired by the user.

In another embodiment of the present invention, the household appliance (1) comprises a memory (6) wherein the signals detected by the sensing means (3) are recorded. The tariff of the energy delivered by the network changes momentarily depending on the load of the network thereby the energy tariff delivered to the household appliance (1) from the network during the day has values different from one another.

In a version of this embodiment, the energy tariff delivered to the household appliance (1) is divided into tariff rates such as the cheapest, cheap, middle and expensive. In another version of this embodiment, the energy tariff delivered to the household appliance (1) shows variability in time depending on the network load and consecutively receives values different from each other.

In this embodiment, the control unit (4) determines the changes in the energy tariff daily by evaluating the momentarily detected discounted rate energy signals from the energy network kept in the memory (6) and the data received from the clock (2). Accordingly, the information about which hours of the day cheaper energy tariff is applied generally is obtained by monitoring the course of the changes in the energy tariff. In the case the user sets the end time ($t_f$) of the selected program, the control unit (4) executes the program within the cheapest energy tariff range by taking into consideration the time constraint of the latest time the program is wanted to be completed by using this data. For example, the energy tariff is generally lower in the late night hours compared with other hours of the day due to the load on the energy network. The data kept in the memory (6) about which hours of the day the discounted rate energy signal is received is evaluated by the control unit (4). From the moment the user makes the program selection, when discounted rate energy signal is received from the network, the control unit (4) controls the daily data kept in the memory (6) whether or not there is a time interval with a tariff lower than the detected discounted rate tariff in the time duration passing until the completion of the program. If there is a lower priced time interval than the detected discounted rate energy tariff before the time the program has to end, then the control unit (4) does not start the program by deciding to start the program in the interval with the lower priced energy instead of starting right away. Consequently, the control unit (4) runs the program in the interval wherein the cheapest tariff energy is given and executes the program with the lowest cost.

In another version of this embodiment, the control unit (4) is configured to determine at which daily time intervals the discounted rate energy is given and warns and guides the user on usage of cheaper rate energy consumption by evaluating the discounted rate energy signals detected from the network by the sensing means (3) and kept in the memory (6) together with the data received from the clock (2). When the user enters the desired program end time ($t_f$), the control unit (4) controls whether or not there is a time interval of discounted rate energy tariff application by the network within the time period passing until the program end time ($t_f$). If there is not a time interval of discounted rate energy tariff application in the total time period ($t_t$) passing until the program end time ($t_f$), the control unit (4) warns the user about the absence of a discounted rate energy tariff application until the desired end time ($t_f$). Furthermore, in this case, the control unit (4) suggests a new end time ($t_f$) wherein a discounted rate energy tariff is applied and guides the user toward the utilization of cheaper rated energy.

By means of the household appliance (1) of the present invention, the desired function/program is executed within the time limit indicated by the user such that the cost of the energy is minimized.

The invention claimed is:

1. A household appliance (1) that comprises a clock (2) for measuring time, a sensing means (3) that detects a discounted rate energy signal coming from an energy network momentarily when connected to the energy network which energy network delivers the discount rate energy wherein the energy tariff changes dynamically, a control unit (4) that evaluates the clock (2) and the signal received from the sensing means (3) and a panel (5) which enables the user to select programs and wherein the control unit (4) that maintains to execute the program as much as possible in the time interval when the discounted rate is applied when the user enters the desired end time ($t_f$) for the program to be executed, by evaluating together the clock (2) data and the momentary energy tariff signal received from the sensing means (3) within the time passing until the end time ($t_f$) and guarantees completion of the program to be executed before the selected end time ($t_f$).

2. The household appliance (1) as in claim 1, wherein the clock (2) is real time clock.

3. The household appliance (1) as in claim 1 or 2, characterized by the control unit (4) that during the execution of a program, runs the program as long as the discounted rate energy signal is received from the sensing means (3), stops the running program when the detected signal changes to the expensive rate energy signal, waits for the discounted rate energy signal from the sensing means (3) in order to continue the program and runs the executed program intermittently such that it is completed before the desired end time ($t_f$).

4. A household appliance (1) comprising a clock (2) for measuring time, a sensing means (3) that detects a discounted rate energy signal coming from an energy network when connected to the energy network wherein an energy tariff changes dynamically, a control unit (4) that evaluates the clock (2) and the signal received from the sensing means (3) and a panel (5) which enables the user to select programs and wherein the control unit (4) that maintains to execute the program as much as possible in the time interval when the discounted rate is applied when the user enters the desired end time ($t_f$) for the program to be executed, by evaluating together the clock (2) data and the momentary energy tariff signal received from the sensing means (3) within the time passing until the end time ($t_f$) and guarantees completion of the program to be executed before the selected end time ($t_f$) and wherein the control unit (4) that, during the execution of a program comprising more than one step, runs the program as long as the discounted rate energy signal is received from the sensing means (3), completes the running program step without interrupting when the detected signal changes and the expensive rate energy signal is detected, does not start the next step, waits for the discounted rate energy signal to be received from the sensing means (3) again in order to continue with the next program step and runs the executed program intermittently such that it is completed before the desired end time ($t_f$).

5. The household appliance (1) as in claim 4, wherein the control unit (4) that comprises a memory (6) wherein the discounted rate energy signal received from the sensing means (3) is recorded and determines at which hours of the day the cheap energy tariff is applied generally by evaluating the discounted rate energy signal momentarily detected from the energy network stored in the memory (6) and the data received from the clock (2).

6. The household appliance (1) as in claim 4, wherein the control unit (4) that determines at which time intervals of the day the discounted rate energy is delivered by the network by evaluating the discounted rate energy signal detected by the sensing means (3) from the network and stored in a memory (6) together with the data received from the clock (2) and after the user enters the program end time ($t_f$), if there is not a time interval wherein discounted rate energy tariff is applied in the total time ($t_t$) passing until the end time ($t_f$), informs the user and suggests a new end time ($t_f$) to the user that remains within a time interval of discounted rate energy tariff application.

7. The household appliance (1) as in claim 4, wherein the clock (2) is real time clock.

8. The household appliance (1) as in claim 7, wherein the control unit (4) that during the execution of a program, runs the program as long as the discounted rate energy signal is received from the sensing means (3), stops the running program when the detected signal changes to the expensive rate energy signal, waits for the discounted rate energy signal from the sensing means (3) in order to continue the program and runs the executed program intermittently such that it is completed before the desired end time ($t_f$).

9. The household appliance (1) as claim 7, wherein the control unit (4) that comprises a memory (6) wherein the discounted rate energy signal received from the sensing means (3) is recorded and determines at which hours of the day the cheap energy tariff is applied generally by evaluating the discounted rate energy signal momentarily detected from the energy network stored in the memory (6) and the data received from the clock (2).

10. The household appliance (1) as in claim 7, wherein the control unit (4) that determines at which time intervals of the day the discounted rate energy is delivered by the network by evaluating the discounted rate energy signal detected by the sensing means (3) from the network and stored in the memory (6) together with the data received from the clock (2) and after the user enters the program end time ($t_f$), if there is not a time interval wherein discounted rate energy tariff is applied in the total time ($t_t$) passing until the end time ($t_f$), informs the user and suggests a new end time ($t_f$) to the user that remains within a time interval of discounted rate energy tariff application.

11. The household appliance (1) as in claim 4, wherein the control unit (4) that during the execution of a program, runs the program as long as the discounted rate energy signal is received from the sensing means (3), stops the running program when the detected signal changes to the expensive rate energy signal, waits for the discounted rate energy signal from the sensing means (3) in order to continue the program and runs the executed program intermittently such that it is completed before the desired end time ($t_f$).

12. The household appliance (1) as in claims 4, 5, 6, 7, 8, 9, 10 and 11 wherein the household appliance is selected from the group consisting of a washing machine, a dryer and a dishwasher.

* * * * *